US010059114B2

(12) United States Patent
Kobayashi

(10) Patent No.: US 10,059,114 B2
(45) Date of Patent: Aug. 28, 2018

(54) LIQUID EJECTING APPARATUS

(71) Applicant: SEIKO EPSON CORPORATION, Tokyo (JP)

(72) Inventor: Haruki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/701,000

(22) Filed: Sep. 11, 2017

(65) Prior Publication Data

US 2018/0086086 A1 Mar. 29, 2018

(30) Foreign Application Priority Data

Sep. 23, 2016 (JP) ..... 2016-185197

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
None
See application file for complete search history.

(56) References Cited

U.S. PATENT DOCUMENTS

| | | | | |
|---|---|---|---|---|
| 6,290,346 | B1 * | 9/2001 | Santhanam | B41J 2/1752 347/86 |
| 6,390,601 | B1 | 5/2002 | Morita et al. | |
| 6,467,867 | B1 * | 10/2002 | Worthington | B41J 2/2135 347/19 |
| 2003/0025762 | A1 * | 2/2003 | Sturgeon | B41J 2/1752 347/49 |
| 2012/0055397 | A1 | 3/2012 | Kodama et al. | |
| 2014/0009540 | A1 | 1/2014 | Matsuzaki et al. | |

FOREIGN PATENT DOCUMENTS

| | | |
|---|---|---|
| JP | 2000-127430 | 5/2000 |
| JP | 2002-254670 | 9/2002 |
| JP | 2003-063029 | 3/2003 |
| JP | 2014-028499 | 2/2014 |
| JP | 2014-196000 | 10/2014 |

* cited by examiner

*Primary Examiner* — Erica Lin
(74) *Attorney, Agent, or Firm* — Workman Nydegger

(57) ABSTRACT

A liquid ejecting apparatus includes, a liquid ejecting head that ejects liquid onto a medium, a plurality of liquid containers 2 that stores liquid which is supplied to the liquid ejecting head, the liquid containers 2 being provided with protrusions 24*a* and 24*b*, and a holder 50 that carries the plurality of liquid containers 2, the holder including wall sections 57 and recesses 58*a* and 58*b* disposed inside the wall sections 57 into which the protrusions 24*a* and 24*b* of each of the plurality of liquid containers 2 are inserted, wherein the wall sections 57 at least adjacent to one another have different heights corresponding to the plurality of liquid containers 2.

4 Claims, 9 Drawing Sheets

LIQUID EJECTING APPARATUS

This application claims priority under 35 U.S.C. § 119 to Japanese Patent Application No. 2016-185197 filed on Sep. 23, 2016, the entire disclosure of which is expressly incorporated by reference herein.

BACKGROUND

1. Technical Field

The present invention relates to a liquid ejecting apparatus which includes a liquid ejecting head that ejects liquid, and a holder that holds a liquid container which supplies liquid to the liquid ejecting head, and more specifically, an ink jet recording apparatus that ejects ink as the liquid.

2. Related Art

A liquid ejecting apparatus which is typically an ink jet recording apparatus such as an ink jet printer and a plotter includes a head unit that is configured to eject liquid as liquid droplets from a cartridge which is a liquid container that stores liquid such as ink, and a carriage that holds the cartridge together with the head unit.

For example, JP-A-2014-28499 discloses a configuration in which projections are provided on the holder of the head unit, corresponding to each of the colors of the cartridges, in order to prevent erroneous insertion when a plurality of cartridges is mounted on the head unit.

However, when the liquid container is mounted on the holder, there is a case where incomplete mounting is erroneously recognized as complete mounting, which causes a problem that a mounting failure is difficult to be visually recognized.

Although erroneous insertion of the liquid container can be prevented by providing a feature that prevents erroneous insertion of the liquid container on the bottom of the holder as disclosed in JP-A-2014-28499, visual recognition of mounting failure of the liquid container is still difficult.

Such a problem is not limited to ink jet recording apparatuses, but also occurs in liquid ejecting apparatuses that eject liquid other than ink.

SUMMARY

An advantage of some aspects of the invention is that a liquid ejecting apparatus that facilitates visual recognition of a mounting failure of the liquid container is provided.

According to an aspect of the invention, a liquid ejecting apparatus includes: a liquid ejecting head that ejects liquid onto a medium; a plurality of liquid containers that stores liquid which is supplied to the liquid ejecting head, the liquid containers being provided with a protrusion; and a holder that carries the plurality of liquid containers, the holder including a wall section, and a recess disposed inside the wall section into which the protrusion of each of the plurality of liquid containers is inserted, wherein the wall sections at least adjacent to one another have different heights corresponding to the plurality of liquid containers. In this aspect, when a mounting failure in which the protrusion of the liquid container is not inserted into the recess of the holder occurs, the protrusion of the liquid container abuts the wall section and is lifted. In addition, since the wall sections adjacent to each other have different heights, the liquid containers adjacent to each other are lifted by different amounts. As a result, a mounting failure can be easily recognized by visually observing variation in the heights of the liquid containers.

The liquid ejecting apparatus according to the above aspect, the wall sections are preferably not arranged in a height order in an arrangement direction of the plurality of liquid containers. Accordingly, a difference in the lifted amounts of the liquid containers adjacent to each other is increased, thereby facilitating visual recognition of a mounting failure.

Further, it is preferred that the holder is movable in a direction perpendicular to a transportation direction of the medium, the plurality of liquid containers are arranged side by side in the transportation direction, and the wall section which corresponds to the liquid container located at a most upstream position in the transportation direction has a highest height. Accordingly, a mounting failure of the liquid container located at a position difficult to be visually recognized can be easily recognized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
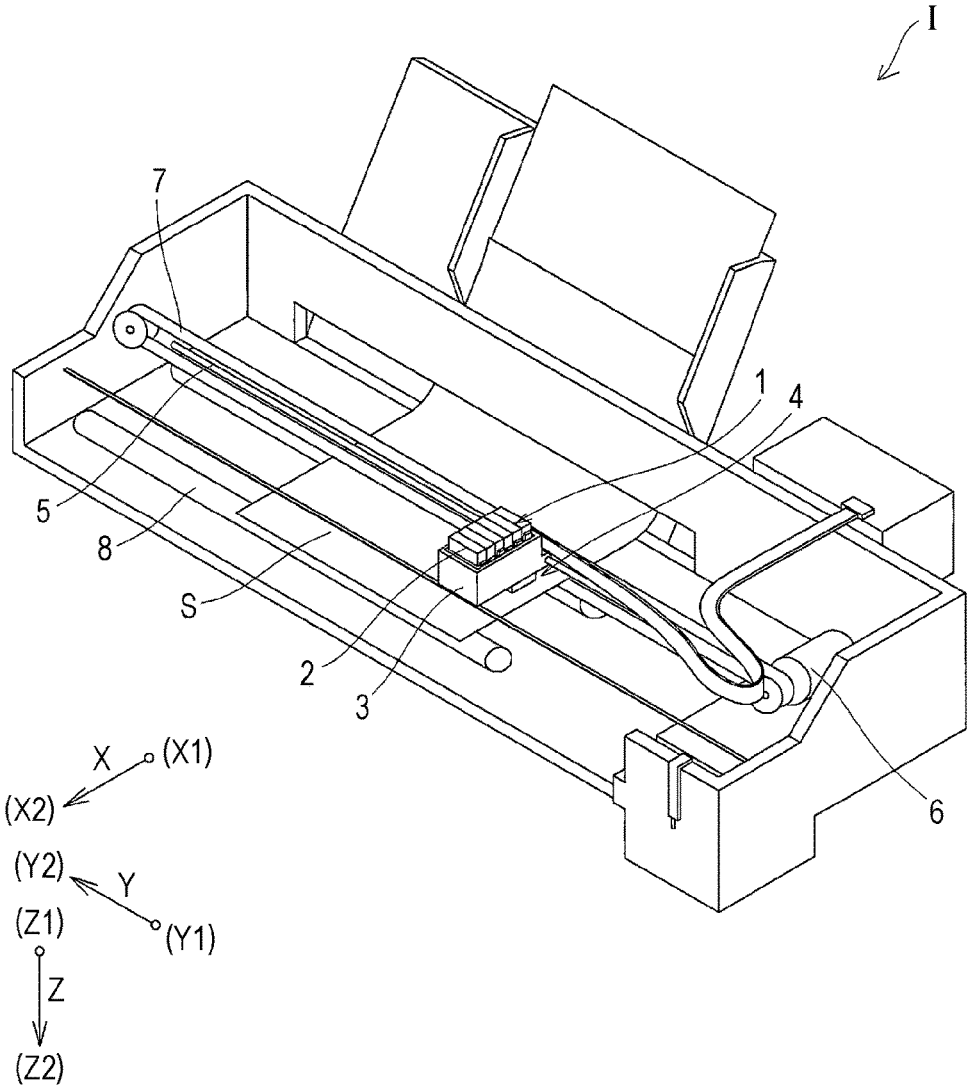
FIG. 1 is a schematic configuration view of a recording apparatus according to Embodiment 1.

The invention will be described in detail with reference to an embodiment. FIG. 1 is a schematic configuration view of an ink jet recording apparatus which is an example of a liquid ejecting apparatus according to Embodiment 1 of the invention.

As shown in FIG. 1, an ink jet recording apparatus I which is an example of a liquid ejecting apparatus of the present embodiment includes an ink jet recording head unit 1 (hereinafter, simply referred to as a head unit 1), which is a liquid ejecting head unit that ejects ink in the present embodiment. The head unit 1 is provided with a cartridge 2 which is a liquid container that stores ink as liquid. The cartridge 2 is detachably attached in the head unit 1. The cartridge 2 may be of a type that stores one type of ink, or alternatively, may be of a type that stores a plurality of types of ink. A plurality of cartridges 2, that is, two or more cartridges 2 are detachably fixed to the head unit. The head unit 1 and the cartridges 2 are mounted on a carriage 3. The carriage 3 is disposed on a carriage shaft 5 which is provided on an apparatus main body 4 to be movable in an axial direction of the carriage shaft 5.

The carriage 3 on which the head unit 1 is mounted is configured to move along the carriage shaft 5 when a driving force of a drive motor 6 is transmitted to the carriage 3 via a plurality of gears, which are not shown in the figure, and a timing belt 7. On the other hand, a transportation roller 8 which serves as a transportation unit is provided in the apparatus main body 4. A recording sheet S, which is a paper medium or the like, is transported by means of the transportation roller 8. The transportation unit which transports the recording sheet S is not limited to the transportation roller 8, but may be a belt, drum, or the like. In this embodiment, a transportation direction of the recording sheet S is referred to as a first direction X, in which an upstream side of the transportation direction of the recording sheet S is referred to as an X1, and a downstream side is referred to as an X2. Further, a movement direction of the carriage 3 along the carriage shaft 5 is referred to as a second direction Y, in which one side of the carriage shaft 5 is referred to as a Y1, and the other side is referred to as a Y2. Moreover, in this embodiment, a direction which is perpendicular to both the first direction X and the second direction Y is referred to as a third direction Z, in which a direction as viewed from the recording sheet S to the head unit 1 is referred to as a Z1, and a direction as viewed from the head unit 1 to the recording sheet S is referred to as a Z2. Note that, the relation among these directions (X, Y, Z) in this embodiment is defined as being perpendicular to one another, the positional relation of these configurations may not be necessarily perpendicular to one another. Further, in this embodiment, the third direction Z is defined as a direction consistent with a vertical direction. The upper side in the vertical direction is referred to as the Z1, and a lower side in the vertical direction lower is referred to as the Z2.

The ink jet recording apparatus I having such a configuration performs printing by ejecting ink droplets from the nozzles of the head unit 1 onto the substantially entire surface of the recording sheet S, while transporting the recording sheet S in the first direction X relative to the head unit 1 and reciprocating the carriage 3 in the second direction Y relative to the recording sheet S. Further, a suction unit 9 performs a suction operation for suctioning ink in the head unit 1 at a desired timing such as during initial filling when the cartridge 2 is mounted, before printing and during printing.

Figure 2:
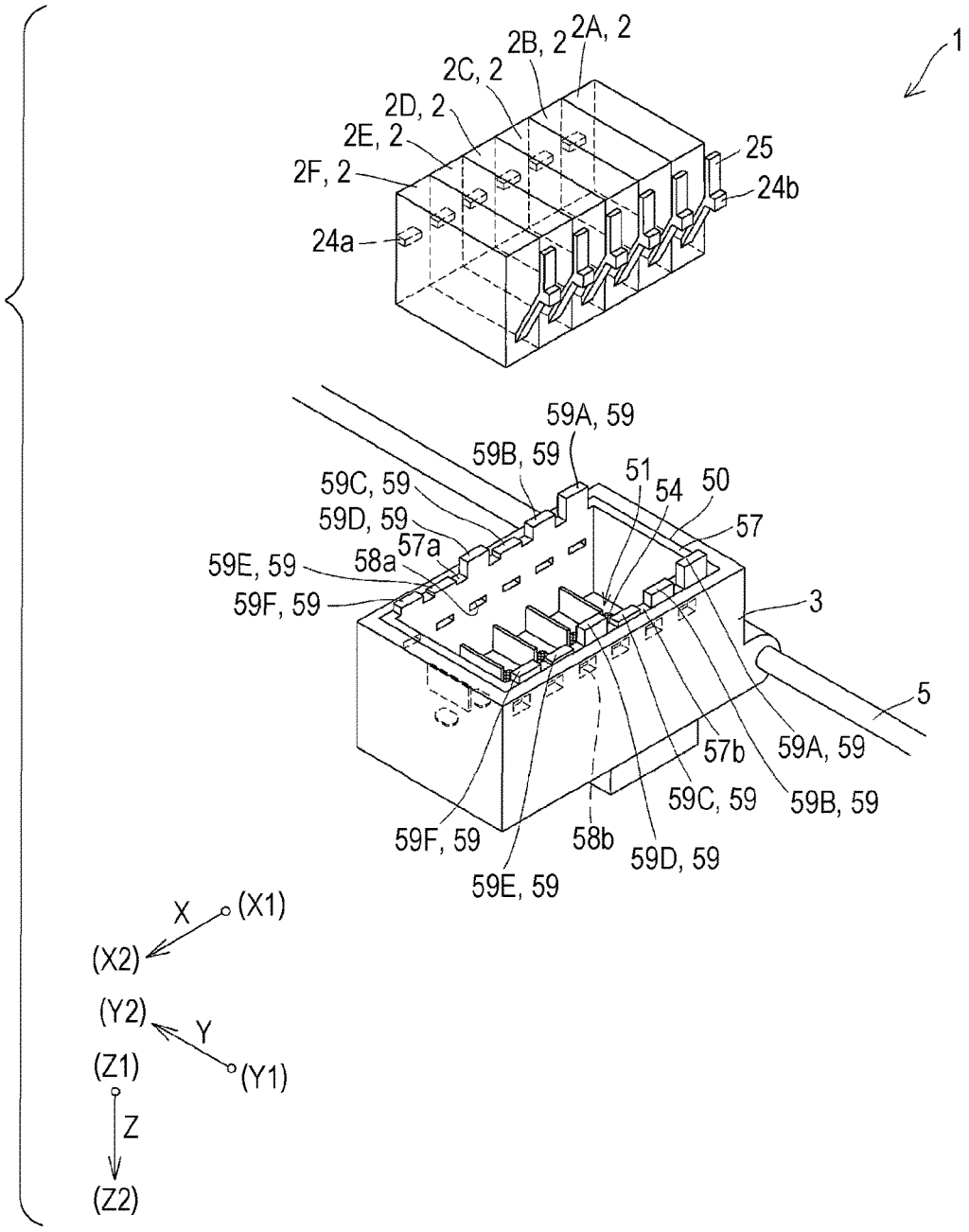
FIG. 2 is a perspective view of a head unit and a carriage according to Embodiment 1.
Figure 3:
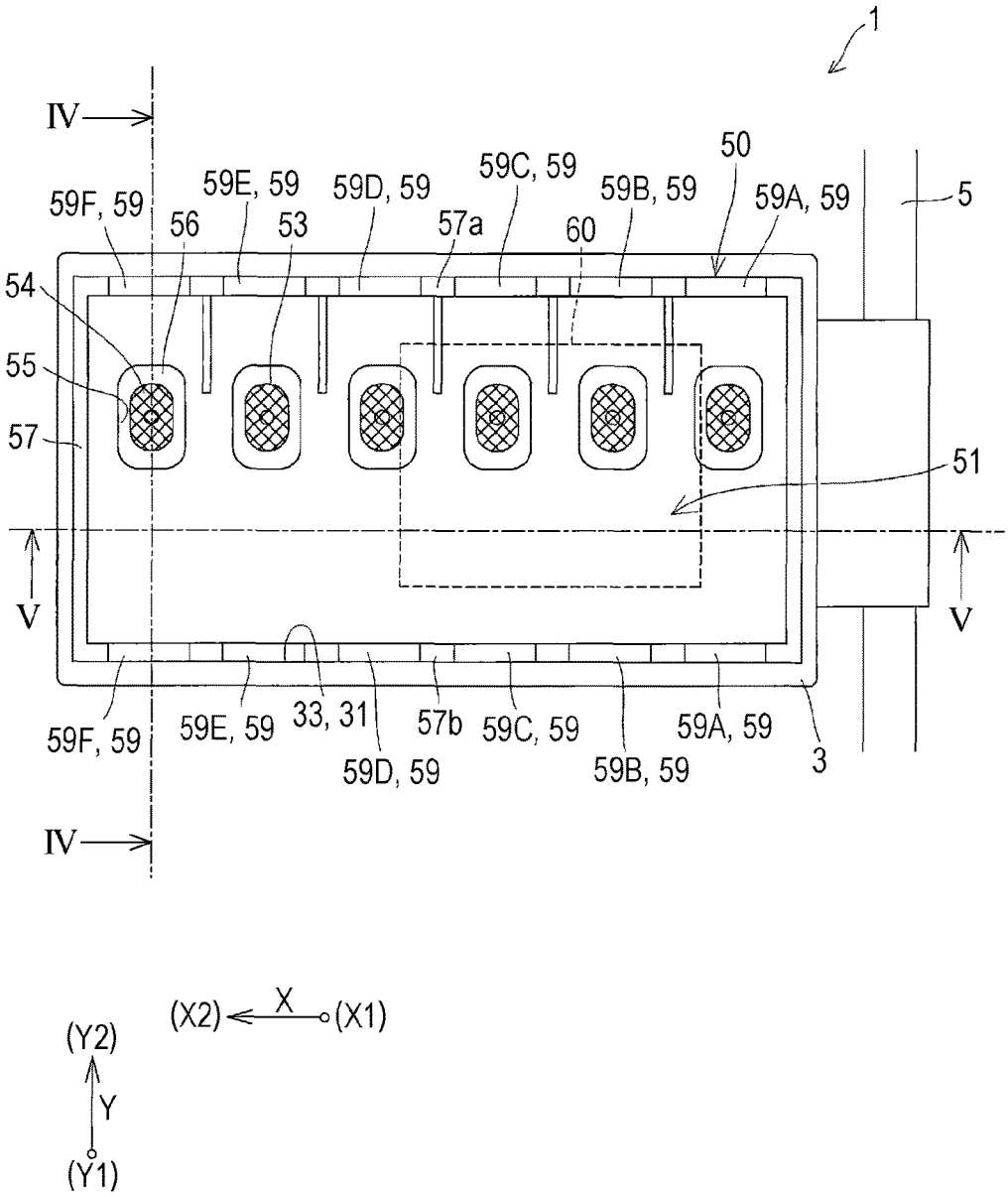
FIG. 3 is a plan view of the head unit and the carriage according to Embodiment 1.
Figure 4:
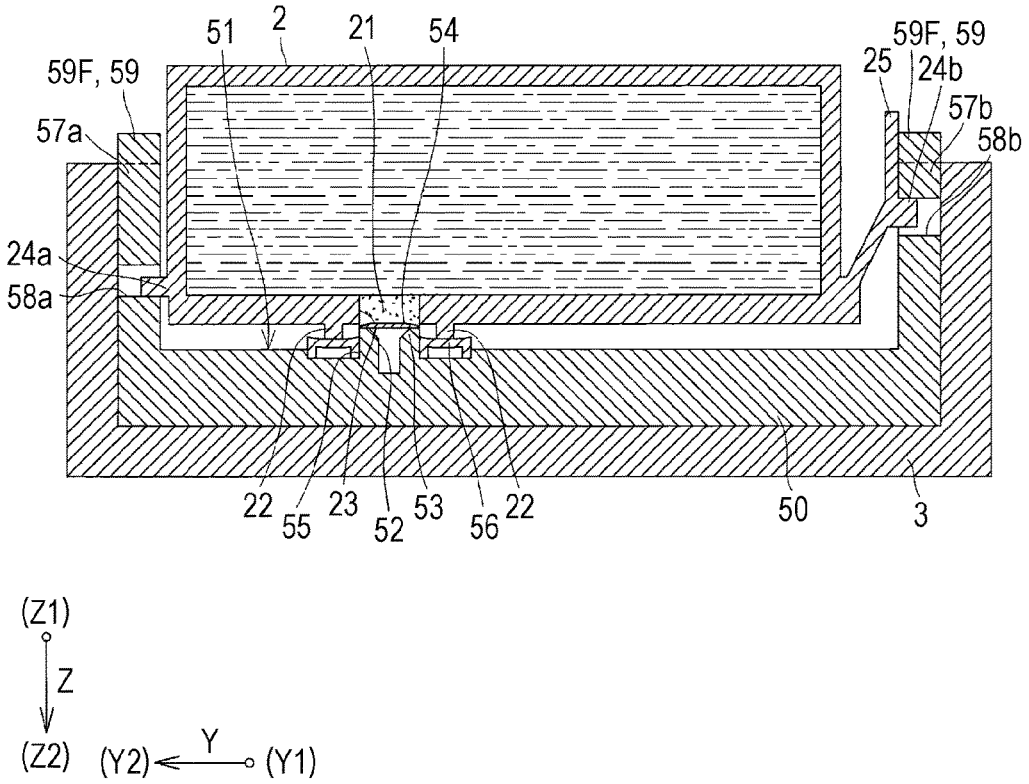
FIG. 4 is a cross-sectional view of the head unit and the carriage according to Embodiment 1.

Further referring to FIGS. 2 to 8, the head unit 1 and the carriage 3 of the present embodiment will be described. FIG. 2 is a perspective view of the head unit and the carriage, FIG. 3 is a plan view of the head unit and the carriage, FIG. 4 is a cross-sectional view taken along the line IV-IV of FIG. 3, and FIG. 5 is a cross-sectional view taken along the line V-V of FIG. 3.

Figure 5:
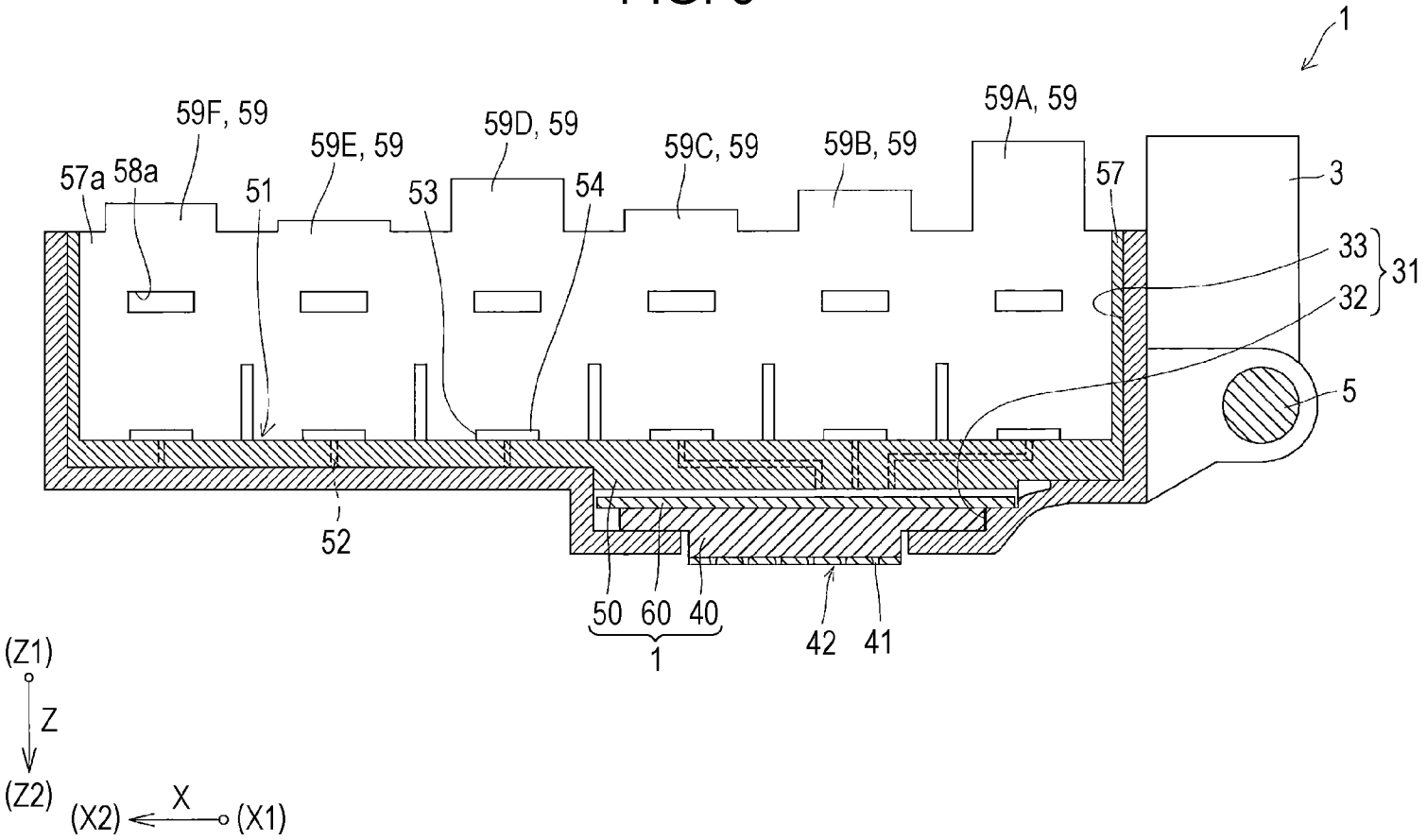
FIG. 5 is a cross-sectional view of the head unit and the carriage according to Embodiment 1.

As shown in FIGS. 2 and 5, the head unit 1 mounted on the carriage 3 includes an ink jet recording head 40 (hereinafter, also referred to as a recording head 40) which is a liquid ejecting head that ejects ink, a holder 50 on which the cartridge 2 is mounted (placed) so as to supply ink to the recording head 40, and a circuit board 60 which is electrically connected to the recording head 40.

The recording head 40 includes nozzles 41 on the Z2-side surface so as to eject ink droplets. The Z2-side surface of the recording head 40 on which the nozzles 41 are disposed is a nozzle surface 42. Further, a pressure generating unit is provided inside the recording head 40, which is not shown in the figure, so as to generate change in pressure in a flow path that communicates with the nozzles 41 and ink in the flow path. The pressure generating unit may be, for example, of a type that ejects ink droplets from the nozzles 41 by changing the volume of the flow path due to deformation of a piezoelectric actuator having a piezoelectric material which exhibits an electromechanical conversion function to thereby generate change in pressure of the ink in the flow path, a type that ejects ink droplets from the nozzles 41 by means of bubbles generated by heat from a heat generating element disposed in the flow path, or a so-called electrostatic actuator that ejects ink droplets from the nozzles 41 by deforming the vibration plate due to electrostatic force generated between the vibration plate and the electrode.

The circuit board 60 is nipped between the recording head 40 and the holder 50 in the third direction Z. That is, the circuit board 60 is held on the Z1-side of the recording head 40. The circuit board 60 is connected to the pressure generating unit via a wiring or the like, which is not shown in the figure, and supplies an external drive signal to the pressure generating unit. Although not shown in the figure, wirings and electronics are implemented on this circuit board 60.

The holder 50 is fixed to the surface of the recording head 40 which faces the circuit board 60, that is, the Z1-side surface with the circuit board 60 interposed therebetween.

The holder 50 includes a cartridge mount section 51 on the Z1-side surface in the third direction Z which holds the plurality of cartridges 2. As shown in FIG. 2, the cartridge 2 of this embodiment has an aspect ratio with a long dimension in one direction and a short dimension in the other direction in plan view as viewed in the third direction Z. That is, the cartridge 2 of the present embodiment has a substantially rectangular shape in plan view as viewed in the third direction Z. In this embodiment, the cartridge 2 is disposed such that the long dimension direction is consistent with the second direction Y, which is the movement direction of the carriage 3. The plurality of (in this embodiment, six) cartridges 2 are arranged side by side in the short dimension direction, that is, in the first direction X and mounted in the cartridge mount section 51. Further, the plurality of cartridges 2 has the same dimension at least in the third direction Z. In this embodiment, the plurality of cartridges 2 has the same shape with the same dimensions in the first direction X, the second direction Y, and the third direction Z. This improves the versatility of the cartridge 2, and allows for mass production of the cartridge 2 at low cost. As a matter of course, the plurality of cartridges 2 is not limited to the above, and may have different dimensions in the first direction X.

Since the plurality of cartridges 2 are arranged side by side in the first direction X in the cartridge mount section 51, the head unit 1 can be reduced in size in the second direction Y. That is, the dimension of the head unit 1 in the second direction Y is determined by the long dimension of the cartridge 2, an increase in size in the second direction Y can be prevented even if the plurality of cartridges 2 are mounted in the cartridge mount section 51. In other words, regardless of the number of the cartridges 2, the head unit 1 can be reduced in size in the second direction Y. Accordingly, the head unit 1 that ejects a plurality of colors of ink can be implemented without increasing the size of the head unit 1 in the second direction Y.

Moreover, the holder 50 is provided with a plurality of ink supply paths 52. The ink supply paths 52 have one end which opens to the cartridge mount section 51 and the other end which opens to the Z2-side surface, which is opposite to the cartridge mount section 51. More specifically, as shown in FIG. 4, a liquid introduction unit 53 which has an ink supply path 52 provided inside is disposed to protrude in a cylindrical shape on the cartridge mount section 51 of the holder 50. A filter 54 is provided on the distal end surface of the liquid introduction unit 53 so as to cover an opening of the ink supply path 52.

The filter 54 serves to remove a foreign matter or air bubbles contained in the ink, and has a plurality of micropores. Examples of such a filter 54 may be a sheet member made of a fiber such as metal or resin finely knitted or braided, or a plate member such as metal or resin having a plurality of micropores penetrating therethrough. This filter 54 is brought into contact with a liquid surface of a supplying unit 21 of the cartridge 2. Further, a cylindrical rib 22 is disposed on the bottom of the cartridge 2 which is located on the Z2-side, and a supply port 23 is disposed in the rib 22 so as to supply ink stored in the cartridge 2 to the holder 50. The supplying unit 21, which is an absorber that absorbs and holds ink, is disposed in the supply port 23. The supplying unit 21 is in surface contact with the filter 54 of the holder 50 at a predetermined pressure, and can be made of, for example, cotton pulp, high molecular water-absorbing polymer, and a porous material such as urethane foam or a non-woven cloth.

A sealing groove 55 in an annular shape is disposed on a periphery of the liquid introduction unit 53 on which the filter 54 of the cartridge mount section 51 is provided. Further, a sealing member 56 is disposed in the sealing groove 55. When the rib 22 of the cartridge 2 abuts the sealing member 56, a surface contact portion between the filter 54 and the supplying unit 21 are sealed.

Further, the cartridge mount section 51 is surrounded by a wall 57 such that the cartridge 2 is detachably held by the cartridge mount section 51 when engaged with the wall 57. More specifically, a first recess 58*a* that penetrates the wall 57 in the thickness direction is provided on one of a pair of opposed wall surfaces 57*a* and 57*b* of the wall 57, that is, in this embodiment, the Y1-side wall surface 57*a* of the pair of wall surfaces which are opposed in the second direction Y. Further, a second recess 58*b* that penetrates the wall 57 in the thickness direction is provided on the other of the pair, which is opposed to the wall surface 57*a* on which the first recess 58*a* is provided, that is, the Y2-side wall surface 57*b*.

Moreover, a first protrusion 24*a* that is inserted into the first recess 58*a*, and a second protrusion 24*b* provided on the surface opposite to the first protrusion 24*a* and inserted into the second recess 58*b* are disposed on the outer peripheral surface of the cartridge 2.

The second protrusion 24*b* is formed on the outer peripheral surface of the lever 25 which is integrally formed with the cartridge 2. One end of the second protrusion 24*b* is fixed to the side surface of the cartridge 2 on the Z2-side, and the other end is a free end. Accordingly, the lever 25 is elastically deformable toward the side surface of the cartridge 2. When the lever 25 elastically deforms, the second protrusion 24*b* formed on the outer peripheral surface of the lever 25 becomes movable in the second direction Y.

Figure 6:
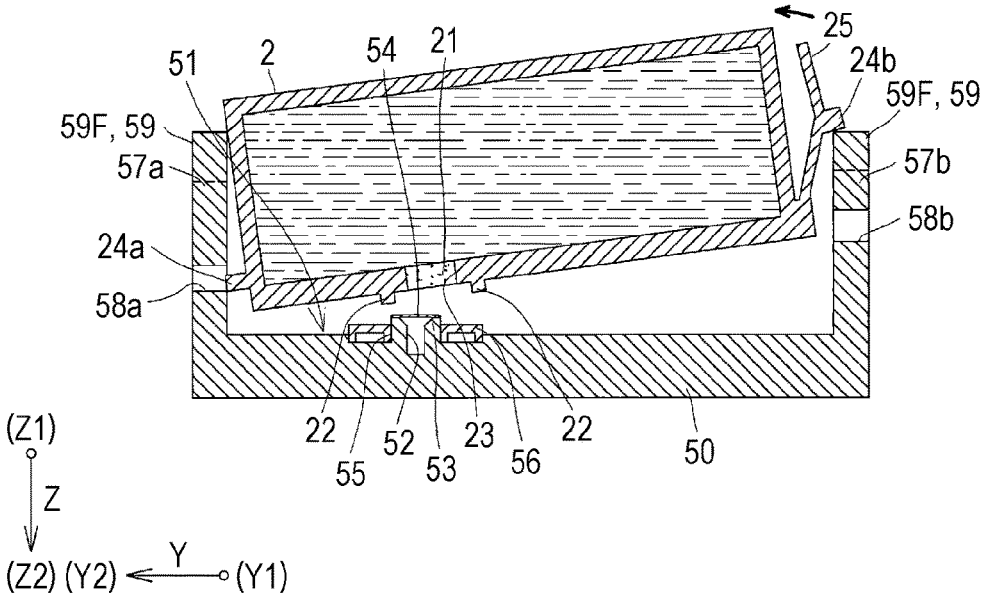
FIG. 6 is a cross-sectional view of the head unit and the carriage according to Embodiment 1.

In mounting of the cartridge 2 in the cartridge mount section 51, the first protrusion 24*a* of the cartridge 2 is first obliquely inserted into the wall 57 of the head unit 1 as shown in FIG. 6.

Figure 7:
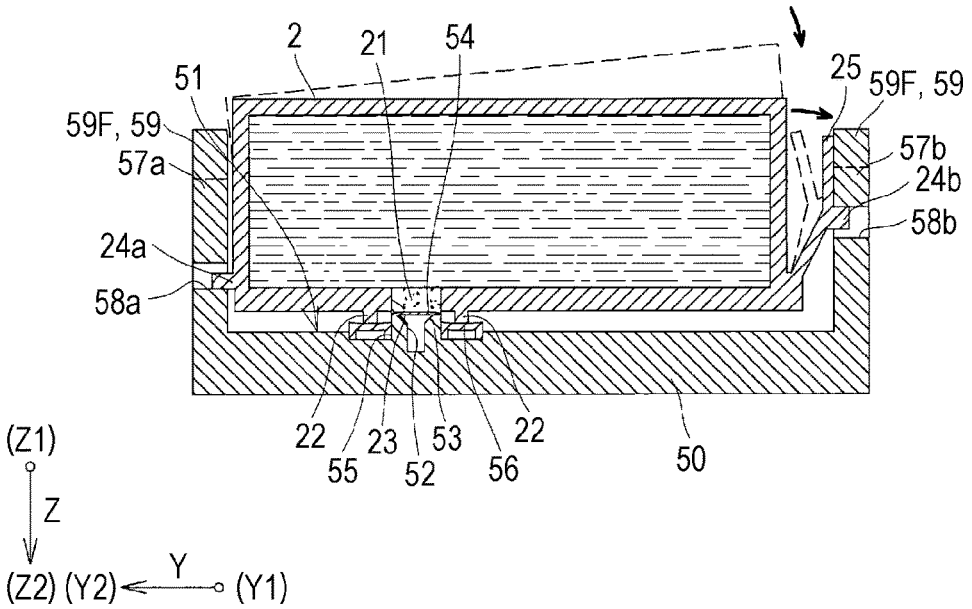
FIG. 7 is a cross-sectional view of the head unit and the carriage according to Embodiment 1.

Then, as shown in FIG. 7, the cartridge 2 is entirely inserted into the wall 57 by rotating the cartridge 2 about the first protrusion 24*a* while the first protrusion 24*a* of the cartridge 2 being inserted into the first recess 58*a*. Here, the lever 25 elastically deforms when pressed by the wall surface 57*b* of the wall 57. Accordingly, the second protrusion 24*b* does not disturb the cartridge 2 being inserted into the holder 50, that is, into the space surrounded by the wall 57. Then, the second protrusion 24*b* engages the second recess 58*b* by elastic force of the lever 25 of the cartridge 2 to thereby allow the cartridge 2 to be held by the wall 57 and mounted in the cartridge mount section 51.

In removal of the cartridge 2 from the cartridge mount section 51, the lever 25 is pressed toward the side surface of the cartridge 2 to thereby disengage the second protrusion 24*b* from the second recess 58*b*, and then the cartridge 2 is pulled out by rotating about the first protrusion 24*a*.

The wall 57 that engages with the cartridge 2 is provided with projections 59 that protrude in the Z1 direction. That is, the projections 59 are provided to pair with each of the wall surfaces 57*a* and 57*b* of the wall 57, that are opposed in the second direction Y, which is an engagement direction of the cartridge 2. In this embodiment, the projections 59 have different heights with respect to the plurality of cartridges 2, that is, have different protruding amounts in the Z1 direction. Here, the description that the plurality of projections 59 have different heights means that the heights of the projections 59 that are at least adjacent to each other in the first direction X are different. That is, the heights of the projections 59 that are not adjacent to each other may be the same. As a matter of course, it is advantageous that all the projections 59 have different heights. It is because this configuration facilitates visual recognition of a mounting failure when a mounting failure of the cartridge 2 occurs, which will be detailed later. Further, in the present embodiment, each of the two projections 59 of a pair in the second direction Y have the same height. That is, the projections 59 are arranged side by side in the first direction X such that the projections 59 on the Y1-side and the projections 59 on the Y2-side have the same height.

Hereinafter, the plurality of cartridges 2 arranged side by side in the first direction X from the X1 to the X2 is each referred to as the cartridges 2A to 2F, and the projections 59 corresponding to the cartridges 2A to 2F are each referred to as the projections 59A to 59F. In this embodiment, the projection 59A located on the outermost position in the X1 direction has the highest height. Since the carriage 3 is typically disposed on the X2-side, which is downstream relative to the carriage shaft 5, the cartridge 2 is replaced with a new one from the X2-side of the carriage 3. Further, since a cover, which is not shown in the figure, is disposed on the X1-side of the carriage 3 so as to be rotatable by a hinge, a mounting failure of the cartridge 2A on the X1-side is difficult to be visually recognized. Accordingly, the projection 59A having the highest height allows for the cartridge 2A that causes a mounting failure to be located at the highest position, thereby facilitating visual recognition of the mounting failure of the cartridge 2. In this embodiment, the projections 59 are defined as 59A, 59D, 59B, 59F, 59C, and 59E in the descending order of the height. The projection 59A has the highest height, and the projections 59 adjacent to each other in the first direction X have different heights.

Figure 8:
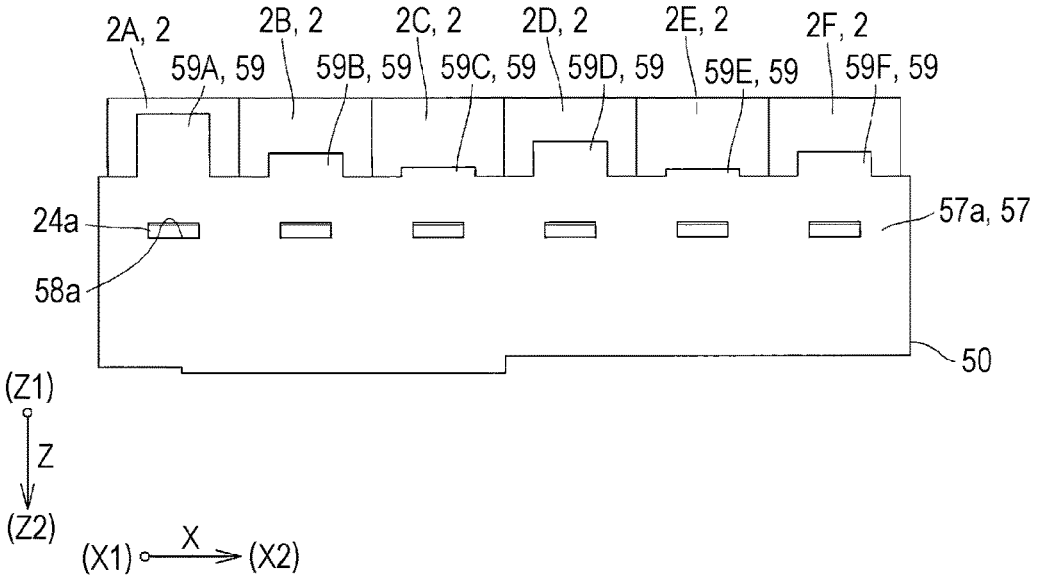
FIG. 8 is a side view of the head unit according to Embodiment 1.

In mounting of the plurality of cartridges 2 on the above holder 50, when the cartridge 2 is completely mounted in the holder 50, the Z1-side surfaces of the plurality of cartridges 2 exhibit the same height, that is, are flush with each other (a flat surface) as shown in FIG. 8.

Figure 9:
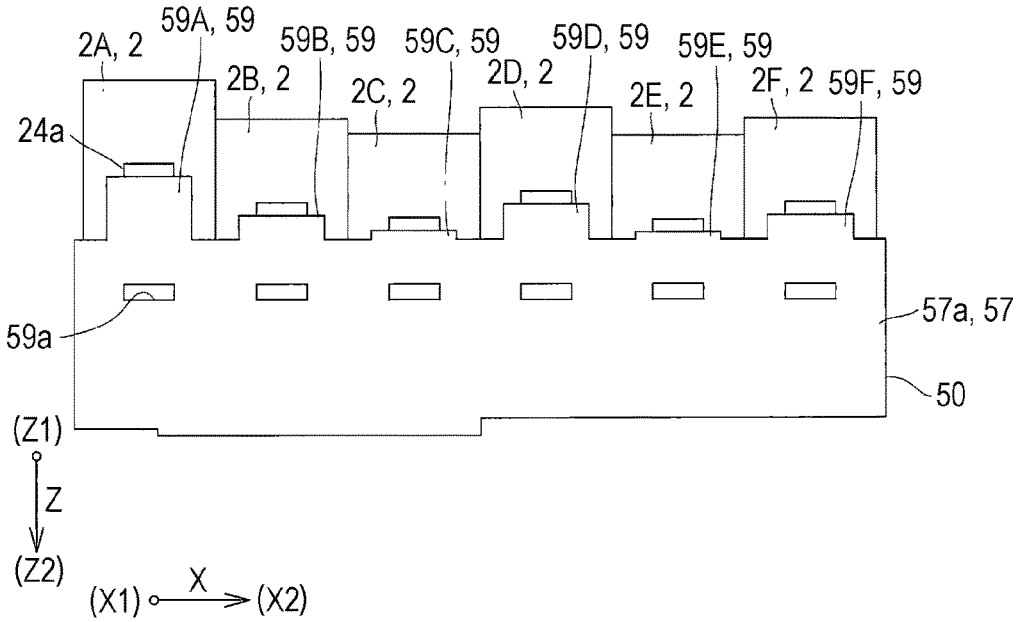
FIG. 9 is a side view of the head unit according to Embodiment 1.

On the other hand, when an operator of the cartridge 2 does not have an intention to engage the first protrusion 24*a* and the second protrusion 24*b* with the first recess 58*a* and the second recess 58*b*, respectively, there may be a case where the cartridges 2 are just placed on the holder 50 and failed to be fitted thereto. In such a case, the first protrusion 24*a* among all the cartridges 2 is failed to be inserted into the first recess 58*a*. The first protrusion 24*a* abuts the end (projection 59) of the wall 57 on the Z1-side, which causes the cartridge 2 to be lifted from the cartridge mount section 51 in the Z1 direction, which is a mounting failure. Further, the second protrusion 24*b* among all the cartridges 2 is failed to be inserted into the second recess 58*b*. The second protrusion 24*b* abuts the end (projection 59) of the wall 57 on the Z2-side, which causes the cartridge 2 to be lifted from the cartridge mount section 51 in the Z1 direction, which is a mounting failure. Here, since the wall 57 has the projections 59 having different heights, the cartridges 2 are positioned with different heights in the third direction Z as shown in FIG. 9. Accordingly, the Z1-side surfaces of the plurality of cartridges 2 are not flush with each other, and provide an uneven surface. As a result, a mounting failure of the cartridges 2 can be easily recognized only by visually checking whether there is an unevenness on the Z1-side surfaces of the cartridge 2.

Figure 10:
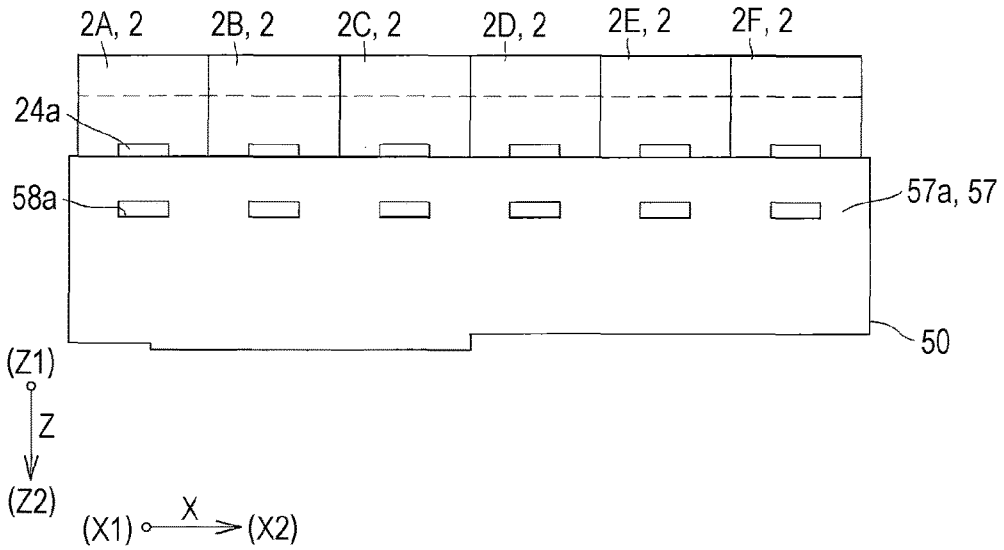
FIG. 10 is a side view of a comparative example of the head unit according to Embodiment 1.

In contrast, if the wall 57 does not have the projections 59, the Z1-side surfaces of plurality of cartridges 2 exhibit the same height and become flush with each other as with the case where the cartridges 2 are completely mounted, as shown in FIG. 10, even if there is a mounting failure. Accordingly, displacement of the positions of the plurality of cartridges 2 on the Z1-side surfaces is not enough to confirm the mounting state by visual observation, and the mounting failure cannot be easily visually recognized.

Moreover, in the case where the projections 59 are provided on the wall 57 as in the present embodiment, a mounting failure of part of the cartridges 2 can also be visually recognized. That is, in a case where at least one cartridge 2 is properly mounted and one or more cartridges 2 have a mounting failure, the mounting failure can also be easily visually recognized since the cartridge 2 of the mounting failure protrudes from the properly mounted cartridges 2 in the Z1 direction. However, the heights of the projections 59 need to be adjusted as appropriate so that the position of the properly mounted cartridge 2 and the position of the cartridge 2 of the mounting failure do not come to the same position. That is, when the cartridge 2 which corresponds to the projection 59 having a large protruding amount is properly mounted and the cartridge 2 which corresponds to the projection 59 having a small protruding amount has a mounting failure, a difference in height $\Delta h1$ of any two projections 59 may be preferably different from a difference in height $\Delta h2$ between the case where the cartridges 2 which correspond to the two projections 59 are properly mounted and the case where the cartridges 2 have a mounting failure ($\Delta h1 \neq \Delta h2$) so that these cartridges 2 do not come to the same position. As a result, a mounting failure of the cartridges 2 can be reliably recognized by preventing erroneous recognition of a mounting failure of the cartridge 2 to thereby reliably recognize a mounting failure of the cartridge 2.

In addition, the projections 59 are not preferably arranged in the height order in the second direction Y. Moreover, the projections 59 are preferably arranged so that the height orders are not in sequence to one another. That is, when the projections 59 are designated in the descending order, the projections 59 adjacent to one another in the first direction X are not preferably in the sequential order. This facilitates visual recognition of a mounting failure of the cartridge 2 by emphasizing the failure. In this embodiment, the projection 59 are defined as 59A, 59D, 59B, 59F, 59C, and 59E in the descending order of the height. The projections 59 adjacent to each other are not in the sequential order of the height. Accordingly, a mounting failure can be easily visually recognized by emphasizing the failure.

The carriage 3 that holds the aforementioned head unit 1 is formed by a hollow member in which the head unit 1 is held. Specifically, as shown in FIGS. 2 and 5, the carriage 3 includes a container 31 that is a space for holding the head unit 1. The container 31 includes a head container 32 on the Z2-side that houses the recording head 40 of the head unit 1, and a cartridge container 33 on the Z1-side on which the cartridge 2 of the holder 50 of the head unit 1 is mounted.

The head container 32 has a small width in the first direction X compared with that of the cartridge container 33, and is disposed at a position which overlaps the cartridge container 33 in plan view as viewed in the third direction Z. Further, the head container 32 is disposed on the X1-side which is deviated from the center of the cartridge container 33 in the first direction X to the carriage shaft 5.

The head container 32 opens to the Z2-side, and the head unit 1 is held in the container 31 with the nozzle surface 42 protruding from the opening on the Z2-side of the head container 32.

Further, the cartridge container 33 opens to the Z1-side so that the cartridge 2 is attached and detached from the opening on the Z1-side.

Other Embodiments

Although an embodiment of the invention has been described above, the basic configuration of the invention is not limited to the above embodiment.

Figure 11:
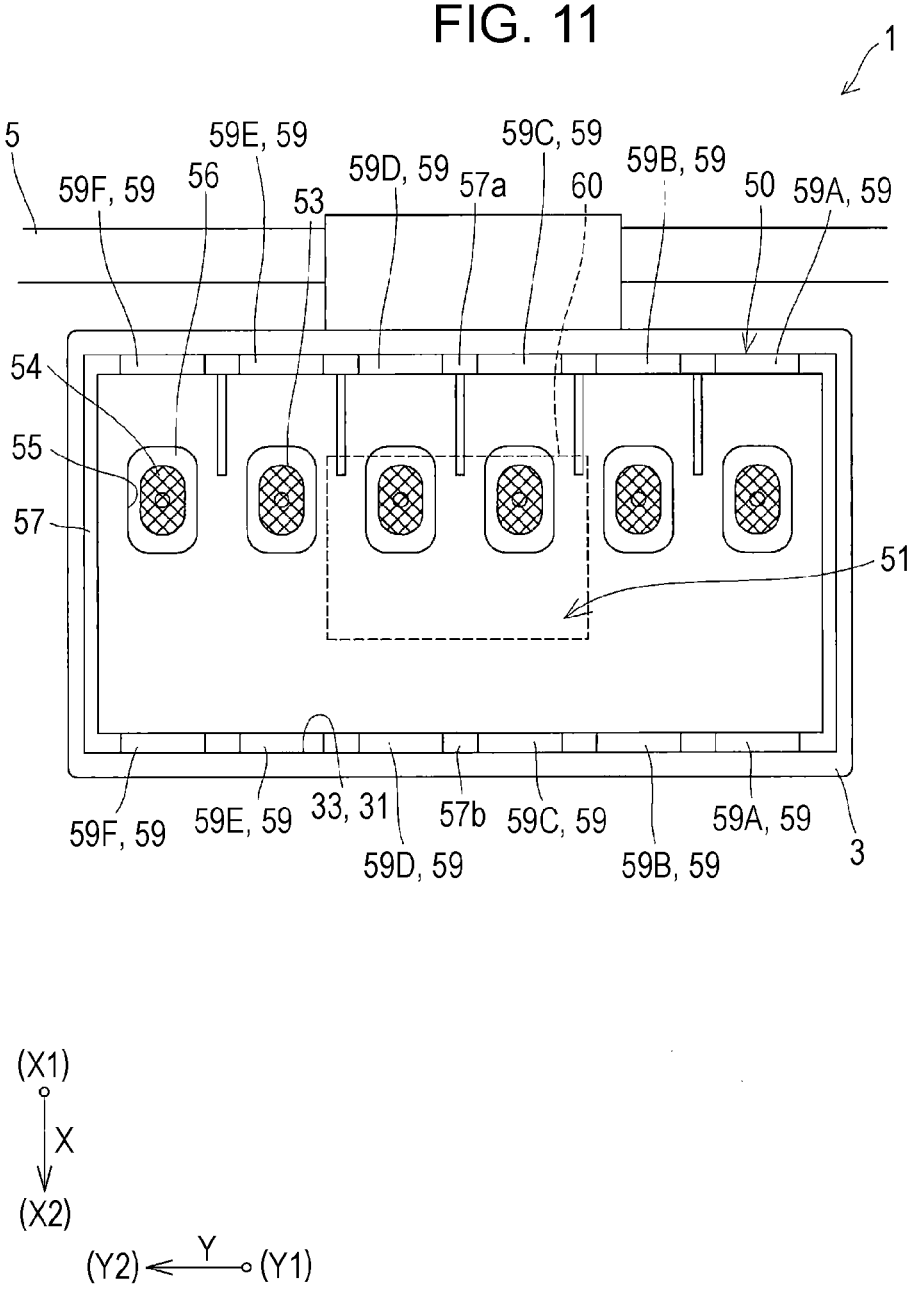
FIG. 11 is a plan view of the head unit and the carriage according to another embodiment.

For example, in the above embodiment, the cartridges 2 are arranged side by side in the first direction X. However, the configuration is not specifically limited thereto, and the cartridges 2 may be arranged side by side, for example, in the second direction Y which is the movement direction of the carriage 3. That is, as shown in FIG. 11, the long dimension direction of the cartridges 2 may be disposed in the first direction X, and the cartridges 2 may be arranged side by side in the short dimension direction. In this configuration, a mounting failure of the cartridges 2 can also be easily recognized as with the case of the above Embodiment 1 by providing a projection on the wall.

Further, in the above Embodiment 1, the first protrusion and the second protrusion are provided on the cartridge 2, and the first recess and the second recess are provided on the holder. However, the configuration is not specifically limited thereto, and the first recess and the second recess may be provided on the cartridge 2, and the first protrusion and the second protrusion may be provided on the holder. As a matter of course, both the protrusion and the recess may be provided on the cartridge, and both the protrusion and the recess may be provided on the holder.

Further, in the aforementioned Embodiment 1, the projections 59 are provided on both the wall surfaces 57*a* and 57*b* of the wall 57. However, the configuration is not specifically limited thereto, and the projections 59 may be provided, for example, on either of the wall surface 57*a* and the wall surface 57*b*. In the case where the projections 59 are provided on either one of the wall surface 57*a* and the wall surface 57*b*, a mounting failure of the cartridge 2 causes unevenness on the Z1-side surface of the plurality of cartridges 2. Accordingly, a mounting failure can be easily recognized. However, in mounting of the cartridge 2 into the holder 50, it is preferred to provide the projections 59 on the wall surface 57*a* having the first recess 58*a* which first engages with the first protrusion 24*a*. This facilitates visual recognition of a mounting failure due to engagement failure between the first protrusion 24*a* and the first recess 58*a*.

Further, in the aforementioned ink jet recording apparatus I, the head unit 1 is described as being mounted on the carriage 3 and moving in the second direction Y. However, the configuration is not specifically limited thereto, and the invention may be applied to, for example, a so-called line type recording apparatus in which the head unit 1 is fixed in position and performs printing only by transporting the recording sheet S such as a paper sheet in the first direction X.

In addition, the above embodiment is described by means of the ink jet recording head unit as an example of a liquid ejecting head and the ink jet recording apparatus as an example of a liquid ejecting apparatus. However, the invention generally covers liquid ejecting heads and liquid ejecting apparatuses, and can also be applied to liquid ejecting heads and liquid ejecting apparatuses that eject liquid other than ink. Examples of other liquid ejecting heads include a variety of head units used for image recording apparatuses such as printers, color material ejecting heads used for manufacturing color filters for liquid crystal displays and the like, electrode material ejecting heads used for manufacturing electrodes for organic electroluminescence (EL) displays, field emission displays (FEDs) and the like, and bioorganic ejecting heads used for manufacturing biochips and the like. The invention can also be applied to the liquid ejecting apparatuses having the above liquid ejecting head.

What is claimed is:

1. A liquid ejecting apparatus comprising:

a liquid ejecting head that ejects liquid onto a medium;

a plurality of liquid containers that stores liquid which is supplied to the liquid ejecting head, the liquid containers being provided with a protrusion; and a holder that is engaged with the plurality of liquid containers, the holder including a wall section, and a recess disposed inside the wall section into which the protrusion of each of the plurality of liquid containers is inserted, wherein the wall sections at least adjacent to one another have different heights corresponding to the plurality of liquid containers, and wherein the plurality of liquid containers are flush with each other in a view from a second direction that is perpendicular to a transportation direction of the medium and that is perpendicular to a first direction.

2. The liquid ejecting apparatus according to claim 1, wherein the wall sections are not arranged in a height order in an arrangement direction of the plurality of liquid containers.

3. The liquid ejecting apparatus according to claim 1, wherein the holder is movable in the second direction that is perpendicular to the transportation direction of the medium, the plurality of liquid containers are arranged side by side in the transportation direction of the medium, and the wall section which corresponds to the liquid container located at a most upstream position in the transportation direction has a highest height.

4. The liquid ejecting apparatus according to claim 1, wherein the first direction is defined as a Z1 direction.

* * * * *